US010989165B1

(12) United States Patent
Chaney

(10) Patent No.: US 10,989,165 B1
(45) Date of Patent: Apr. 27, 2021

(54) SYSTEM AND METHOD FOR OBTAINING A HIGH TORQUE OUTPUT FROM BOUYANT ELEMENTS TRAVELING THROUGH A LIQUID MEDIUM

(71) Applicant: Ray Chaney, Sidney, OH (US)

(72) Inventor: Ray Chaney, Sidney, OH (US)

( * ) Notice: Subject to any disclaimer, the term of this patent is extended or adjusted under 35 U.S.C. 154(b) by 0 days.

(21) Appl. No.: 16/057,943

(22) Filed: Aug. 8, 2018

Related U.S. Application Data

(60) Provisional application No. 62/542,700, filed on Aug. 8, 2017.

(51) Int. Cl.
*F03B 17/04* (2006.01)

(52) U.S. Cl.
CPC ..... *F03B 17/04* (2013.01)

(58) Field of Classification Search
CPC ..... F03B 17/04; F03B 13/26; F03B 13/16; F03B 13/188; F03B 13/1885; F03B 13/20; F03B 15/00; F05B 2240/93; F05B 2260/4031; F05B 2220/706; F05B 2240/97; F05B 2280/5001; Y10S 415/916; Y02E 10/38
See application file for complete search history.

(56) References Cited

U.S. PATENT DOCUMENTS 3,857,242 A 12/1974 Gilmore
4,242,868 A 1/1981 Smith
4,254,622 A 3/1981 Denson, Sr.
4,326,132 A 4/1982 Bokel
4,498,294 A 2/1985 Everett
4,726,188 A 2/1988 Woolfolk
5,944,480 A 8/1999 Forrest
6,305,165 B1 10/2001 Mizuki, Sr.
7,134,283 B2 * 11/2006 Villalobos ..... F03G 7/10 60/639
8,011,182 B2 9/2011 Hastings
8,171,729 B2 * 5/2012 O'Briant ..... F03B 17/04 60/495
8,358,021 B2 * 1/2013 Chow ..... F03B 17/04 290/1 C
8,516,812 B2 8/2013 Manakkattupadeettathil
8,646,267 B1 2/2014 Pedziwiatr
(Continued)

FOREIGN PATENT DOCUMENTS

WO 2014035267 3/2014

*Primary Examiner* — Shafiq Mian
(74) *Attorney, Agent, or Firm* — John Rizvi; John Rizvi, P.A.—The Patent Professor®

(57) ABSTRACT

A power-generating wheel system is provided and includes a liquid-filled riser tube, air balls circulating therethrough due to buoyancy, a top wheel located adjacent a top opening of the riser tube and having air ball receiver cavities and a second wheel located adjacent a bottom opening of the riser tube and having a sealed housing for releasing the air balls into the riser tube and receiving liquid from the riser tube. As air balls exit the top opening of the riser tube they rotate the first wheel, this rotation being transferred to the second wheel by a drive chain. A transfer system transfers the torque on the second wheel to an external device to be powered. A return chute returns the air balls from the first wheel back to the second wheel. A liquid supply system is provided to maintain the riser tube full of liquid.

17 Claims, 4 Drawing Sheets

(56) References Cited

U.S. PATENT DOCUMENTS

| | | | | |
|---|---|---|---|---|
| 8,756,932 | B2 * | 6/2014 | Pirincci | H02K 53/00 60/496 |
| 9,160,212 | B2 | 10/2015 | McCoy | |
| 2005/0039449 | A1 | 2/2005 | Hashimoto | |
| 2007/0080540 | A1 | 4/2007 | Tung | |
| 2008/0264056 | A1 | 10/2008 | Tung | |
| 2010/0031651 | A1 * | 2/2010 | Spataro | F03B 17/02 60/495 |
| 2010/0126804 | A1 * | 5/2010 | Sabapathy | F03G 7/10 185/32 |
| 2014/0196450 | A1 * | 7/2014 | Boyd | F03B 17/04 60/495 |
| 2015/0020518 | A1 | 1/2015 | Manoj | |
| 2015/0211381 | A1 * | 7/2015 | Torrent | F03B 17/04 290/1 A |
| 2017/0130692 | A1 * | 5/2017 | Chaney | F03B 17/04 |

* cited by examiner

SYSTEM AND METHOD FOR OBTAINING A HIGH TORQUE OUTPUT FROM BOUYANT ELEMENTS TRAVELING THROUGH A LIQUID MEDIUM

CROSS-REFERENCE TO RELATED APPLICATIONS

This application claims the benefit of U.S. Provisional Patent Application Ser. No. 62/542,700, filed on Aug. 8, 2017, which is incorporated by reference herein in its entirety.

FIELD OF THE INVENTION

The present invention relates generally to power generation systems, and more particularly, to a power-generating wheel system and method utilizing the buoyant effects of a liquid and the weight of said liquid to generate a high output torque for use in operating machinery or electrical power generating systems.

BACKGROUND OF THE INVENTION

Engines providing a high output torque are utilized to drive many types of mechanical devices, such as belt driven saws, drills, conveyors, and electrical devices such as electric generators. The high torque provided by these engines is often needed to rotate relatively large diameter drive wheels which then, in turn, can be connected to smaller diameter wheels to increase the revolutions per minute (rpm) provided to a drive shaft of the driven mechanical or electrical device.

The engines themselves often need an external source of power to operate. Many are driven by a local power grid which provides electricity to operate the engines. In many remote areas of the world a localized power grid is often unavailable. The know methods of providing electricity to the engines in these cases are by providing solar or wind electric generating devices or by having a small localized "mini" hydro-electric plant operating off a stream or river system. The problems with these methods are that they rely entirely on unpredictable, and often unreliable, environmental conditions including the presence and strength of sunlight, the speed and direction of wind, and the continuity, volume and velocity of the water flow. The common problem with all these systems is the continuity of the source of energy be it sunlight, wind or liquid.

Accordingly, there is an established need for an alternative, high output torque system which can provide a consistent and continuous torque.

SUMMARY OF THE INVENTION

The present invention is directed to a power-generating wheel system and method that is capable of generating a large amount of torque on a continuous basis to an external device. The power-generating wheel system includes a liquid-filled riser tube containing a plurality of buoyant balls having a density less than that of the surrounding liquid, a top wheel located adjacent a top opening of the riser tube and having a plurality of ball receiver cavities and a second wheel located adjacent a bottom opening of the riser tube and having ball receiver cavities for releasing the balls into the riser tube and receiving liquid from the riser tube. As the balls exit the top opening of the riser tube they generate a torque on the first wheel and rotate the first wheel. A drive chain or other elongated drive element connects the first wheel to the second wheel to transfer the torque on the first wheel to the second wheel. A transfer system can be provided to transfer the torque on the second wheel to an external device to be powered. A return chute can be provided to return the balls from the first wheel back to the second wheel and a liquid supply system can be provided to maintain the riser tube full of liquid.

In a first implementation of the invention, a power-generating wheel system comprises a drive system including an ascending, hollow riser tube having a top opening and a bottom opening, wherein the riser tube is configured to contain a liquid forming a liquid column within the riser tube. The system further includes a rotatable, first wheel and a rotatable, second wheel. The first wheel is positioned adjacent the top opening of the riser tube and has a plurality of receiver cavities configured to sequentially align with the top opening of the riser tube. A pivot point of the first wheel is horizontally offset from a centerline of the riser tube to a first side. The second wheel, in turn, is positioned adjacent the bottom opening of the riser tube and has a plurality of receiver cavities configured to sequentially align with the bottom opening of the riser tube. A pivot point of the second wheel is horizontally offset from the centerline of the riser tube to a second side opposite the first side. An elongated drive element is provided connecting the first wheel to the second wheel such that a rotation of the first wheel causes a rotation of the second wheel via the elongated drive element. The system further includes a plurality of balls configured to float in the liquid. A liquid supply system is provided, which is configured to maintain the riser tube full of the liquid such that a ball rising through the liquid column of the liquid exits the top opening of the riser tube and enters one of the receiver cavities of the first wheel with a buoyant force causing the first wheel to rotate and consequently transmitting rotation to the second wheel through the elongated drive element.

In a second aspect, each receiver cavity of the second wheel can be configured to face the bottom opening of the riser tube such that liquid is transferred from the riser tube to the receiver cavity and a ball housed within the receiver cavity is buoyantly released from the receiver cavity into the riser tube.

In another aspect, the second wheel can be configured to rotate by a torque applied on the second wheel by the liquid being transferred to each receiver cavity from the riser tube.

In another aspect, the drive system can further include a return chute having a top opening adjacent the top wheel for receiving balls from the receiver cavities of the top wheel.

In another aspect, the return chute can include a bottom opening adjacent the bottom wheel for depositing the balls into the receiver cavities of the second wheel.

In another aspect, the drive system can further include a second elongated drive element connecting the second wheel to an external device to be powered.

In another aspect, the power-generating wheel system can further include a transfer assembly connected to the second elongated drive element to transfer a torque received from the second elongated drive element to the external device.

In another aspect, the transfer assembly can further include a flywheel and an elongated transfer element connected to the external device.

In another aspect, the second wheel can include a stationary housing containing a rotatable valve which is rotatable relative to the housing and contains the plurality of receiver cavities of the second wheel. The housing can include a dry side through which the rotatable valve rotates devoid of liquid and a wet side through which the rotatable valve rotates when the rotatable valve contains liquid in the receiver cavities.

In another aspect, the receiver cavities of the rotatable valve can be defined by a first side sealing ring, a second side sealing ring and cross sealing rails which provide a sealed fluid communication between each receiver cavity of the rotatable valve and the bottom opening of the riser tube.

In another aspect, the liquid supply system can include a liquid tank and a pressurized liquid supply tube providing fluid communication from the liquid tank to the top opening of the riser tube.

In another aspect, the liquid supply system can include a liquid tank configured to receive liquid from the plurality of receiver cavities of the second wheel.

In another aspect, the power-generating wheel system can further include a liquid return system including a dump sluice positioned beneath the second wheel and a liquid wheel positioned within the liquid tank. The dump sluice is configured to receive liquid from the receiver cavities of the second wheel and force the liquid onto the liquid wheel to return the liquid to the liquid tank.

In another aspect, the liquid supply system can include a first liquid tank, a pressurized liquid supply tube providing fluid communication from the first liquid tank to the top opening of the riser tube, a second liquid tank configured to receive liquid from the plurality of receiver cavities of the second wheel, and a liquid line providing fluid communication from the second tank to the first tank.

In another aspect, the liquid supply system can further include a pump configured to pump liquid through the liquid line from the second tank to the first tank.

In another aspect, the riser tube can be vertical.

In another aspect, the liquid can include water, or be water.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a power-generating system that is capable of utilizing the buoyant effects of a liquid on an object to create a high torque output to a drive shaft in order to power external devices.

Figure 1:
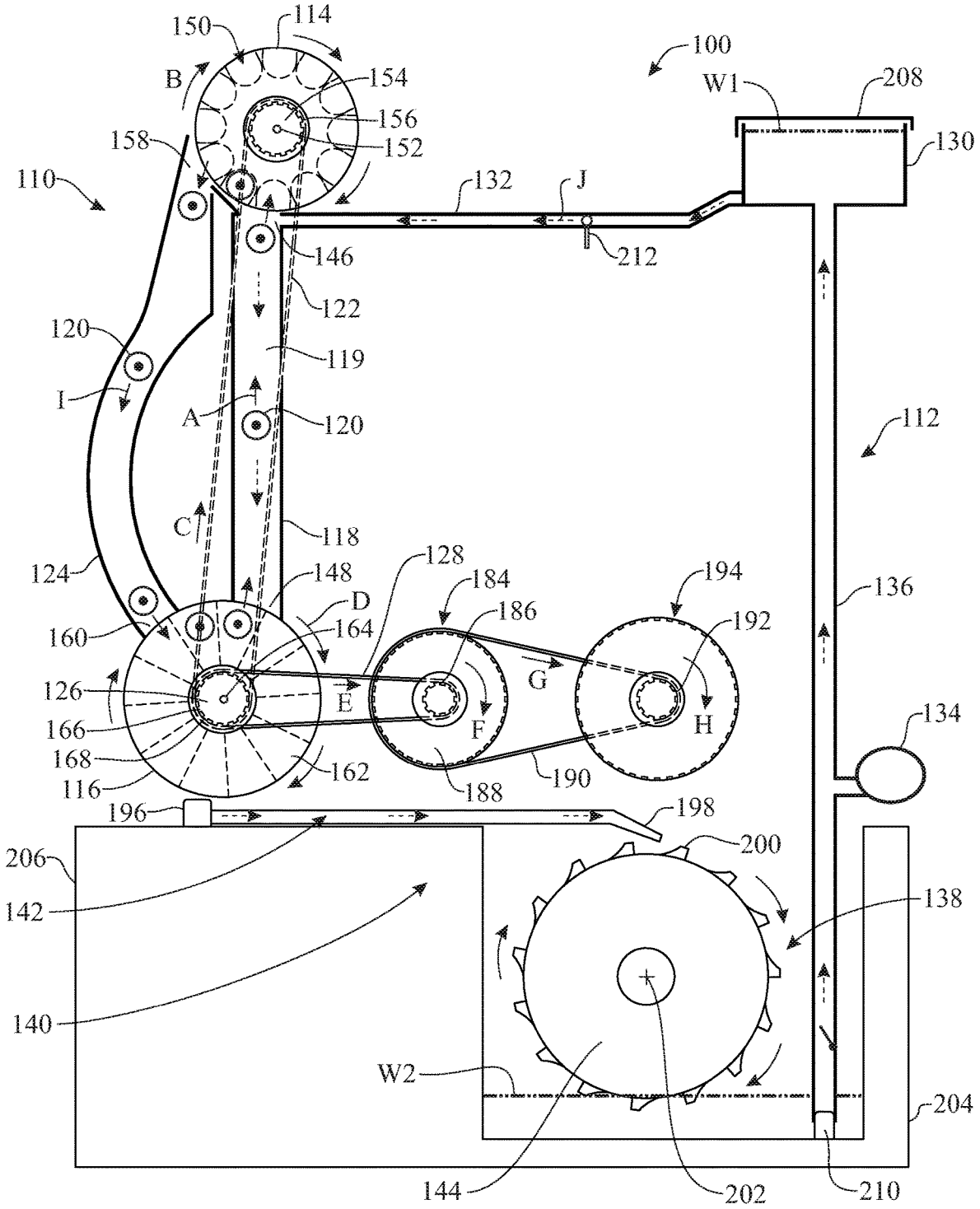
FIG. 1 presents a schematic front elevation view of a power-generating wheel system in accordance with an illustrative embodiment of the present invention, showing the positioning of an air ball relative to a riser tube of the power-generating wheel system.
Figure 2:
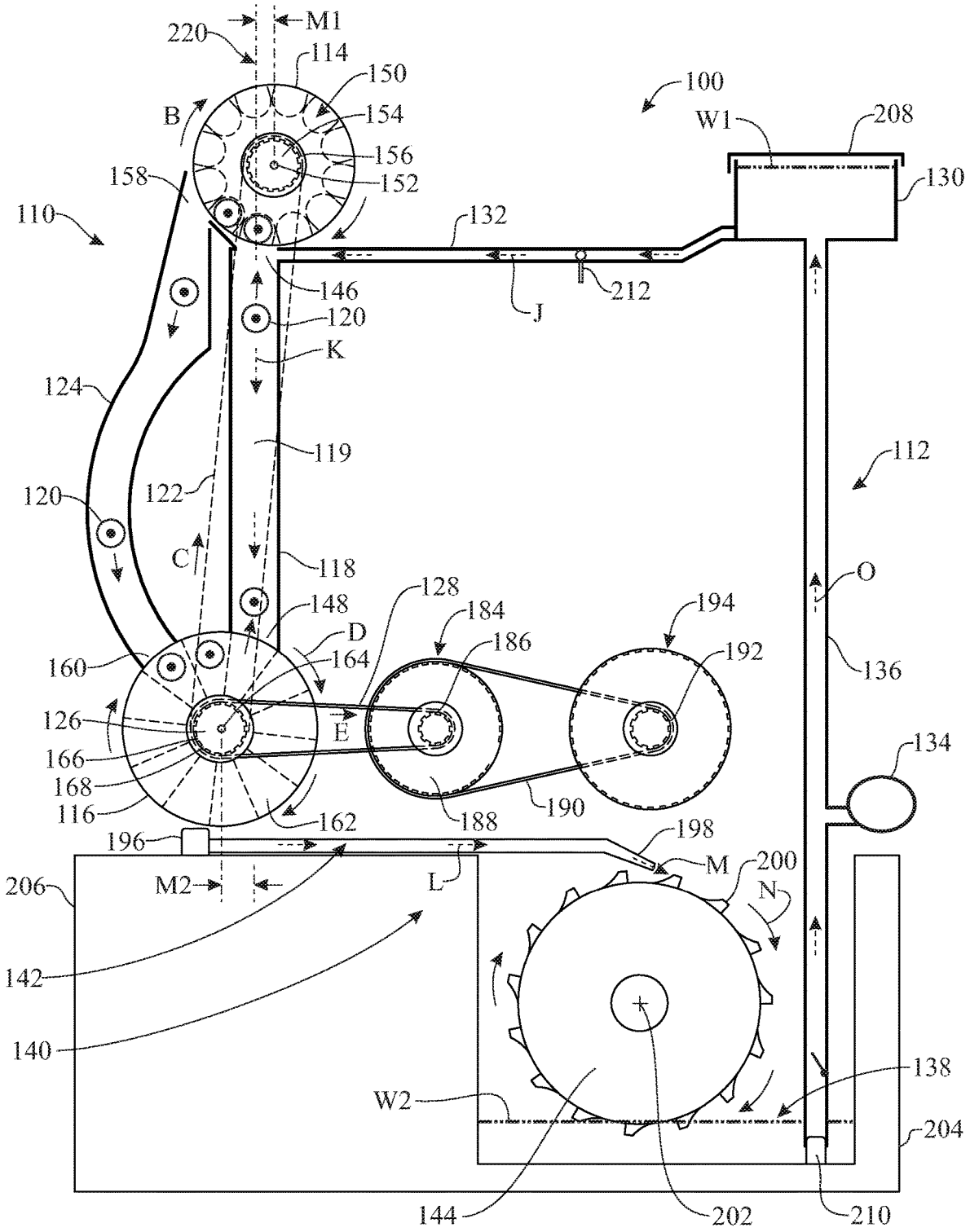
FIG. 2 presents a schematic front elevation view of the power-generating wheel of FIG. 1, illustrating the deployment of the air ball into the riser tube of the power-generating wheel system.

Retelling initially to FIGS. 1 and 2, a power-generating wheel system 100 is illustrated in accordance with an exemplary embodiment of the present invention, configured as a system involving several rotating wheels capable of generating torque, i.e. mechanical power which can in turn be used to generate electrical power or for other uses. As shown, the power-generating wheel system 100 depicted herein generally includes a drive system 110 and liquid supply system 112. A liquid, such as water, is provided b the liquid supply system 112 to the drive system 110 and is passed through the drive system 110 to generate a high output torque as will be described in detail hereinafter. The drive system 110 generally includes a top wheel 114, a bottom wheel 116 and a riser tube 118 extending from the top wheel 114 to the bottom wheel 116. A plurality of gas- or air-containing bodies, hereinafter referred to generally as air balls 120, are provided within the drive system 110 and are configured to float up through the riser tube 118 through a liquid column 119 contained within the riser tube 118 and provided by the liquid supply system 112. The movement of the rising air balls 120 into the top wheel 114 causes the top wheel 114 to rotate. An elongated drive element, such as a chain or belt (hereinafter referred to generally as drive chain 122) interconnects the top wheel 114 and bottom wheel 116 so that rotation of the top wheel 114 causes the bottom wheel 116 to rotate to generate an output torque from the system. In other words, the rotating top wheel 114 advances the drive chain 122 which in turn rotates the bottom wheel 116. A ball return chute 124 is provided in the drive system 110. The ball return chute 124 receives the air balls 120 from the top wheel 114 and guides them back down into the bottom wheel 116, which is configured to receive the falling air balls 120 and feed them back to the riser tube 118. An output shaft 126 of the bottom wheel 116 is connected both to the drive chain 122 and to a second elongated drive.

The liquid supply system 112 of the present embodiment generally includes a liquid pressure tank 130 and a liquid supply tube 132. The liquid supply tube 132 extends between the liquid pressure tank 130 and the riser tube 118 of the drive system 110 for providing liquid into the riser tube 118. The liquid supply system 112 additionally includes a liquid pump 134, a liquid line 136 and a bottom tank 138. The bottom tank 138 contains a source of liquid which is pumped up through the liquid line 136 by the liquid pump 134 and into the liquid pressure tank 130. The liquid pump 134 maintains the liquid pressure tank 130 full to a required liquid level and thus guarantees a sufficient liquid pressure in the liquid supply tube 132.

The liquid supply 112 system may additionally include a liquid return system 140 for receiving liquid passing through the drive system 110 and returning it to the liquid supply system 112. The liquid return system 140 depicted herein includes a dump sluice 142 positioned beneath the bottom wheel 116 and a liquid wheel 144 located within the bottom tank 138. Liquid entering a top opening 146 of the riser tube 118 passes down through the riser tube 118 and exits a bottom opening 148 of the riser tube 118. The liquid is deposited into the bottom wheel 116 as will be described in greater detail hereinafter and is dumped onto the dump sluice 142 which in turn directs the liquid onto the liquid wheel 144 to rotate the liquid wheel 144. As the liquid wheel 144 rotates it dumps the liquid back into the bottom tank 138 to complete the flow of the liquid through the liquid supply system 112.

With continued reference to FIGS. 1 and 2, in order to move the air balls 120 through the drive system 110, the top wheel 114 is provided with a plurality of circumferentially spaced receiver cavities 150. The receiver cavities 150 are sized to loosely catch and accept a single air ball 120 as the air ball 120 exits the top opening 146 of the riser tube 118. The top wheel 114 rotates about a central pivot point 152 on an attached cogged shaft 154. The cogged shaft 154 includes a plurality of teeth 146 which engage the drive chain 122. As the air balls 120 are rotated with the top wheel 114, the receiver cavities 150 pass over a top opening 158 in the return chute 124 and deposit the air balls 120 into the return chute 124 through the top opening 158 of the return chute 124. By sizing the receiver cavities 150 larger than the air balls 120, the air balls 150 can easily fall out of the receiver cavities 150 and be deposited into the return chute 124. The air balls 120 then fall down through the return chute 124 due to gravity and exit the return chute 124 through a bottom opening 160 of the return chute 124 where they are released into the bottom wheel 116 as described hereinbelow.

As noted hereinabove, the top wheel 114 includes a plurality of circumferentially spaced receiver cavities 150 to catch the air balls 150 as they come out of the top opening 146 of the riser tube 118. Likewise, the bottom wheel 116 includes a plurality of circumferentially spaced receiver cavities or buckets 162 for receipt of the air balls 120 as they fall out through the bottom opening 160 of the return chute 124. The bottom wheel 116 also rotates about a pivot point 164 and includes a cogged surface 166 on the output shaft 126. The cogged surface 166 includes a plurality of teeth 168 in engagement with the drive chain 122. Thus, the top and bottom wheels 114 and 116, respectively, rotate together through the drive chain 122. The bottom wheel 116 is configured so that, as it rotates about the pivot point 164, the bottom buckets 162 individually and sequentially register with the bottom opening 148 of the riser tube 118 in a watertight manner. When said bottom opening 148 is in registration with a bucket 162, the bucket 162 receives an amount of liquid from the riser tube 118 (the amount of liquid exiting the bottom opening 148 of the riser tube 118 due to gravity and the pressure of the liquid column 119) and, in turn, the air ball 120 housed inside the bucket 162 exits the bucket 162 upward, entering the riser tube 118, and travels upward through the riser tube 118 due to buoyancy. The liquid received within the bucket 162 is then transferred to the liquid return system 140 as described heretofore.

Figure 3:
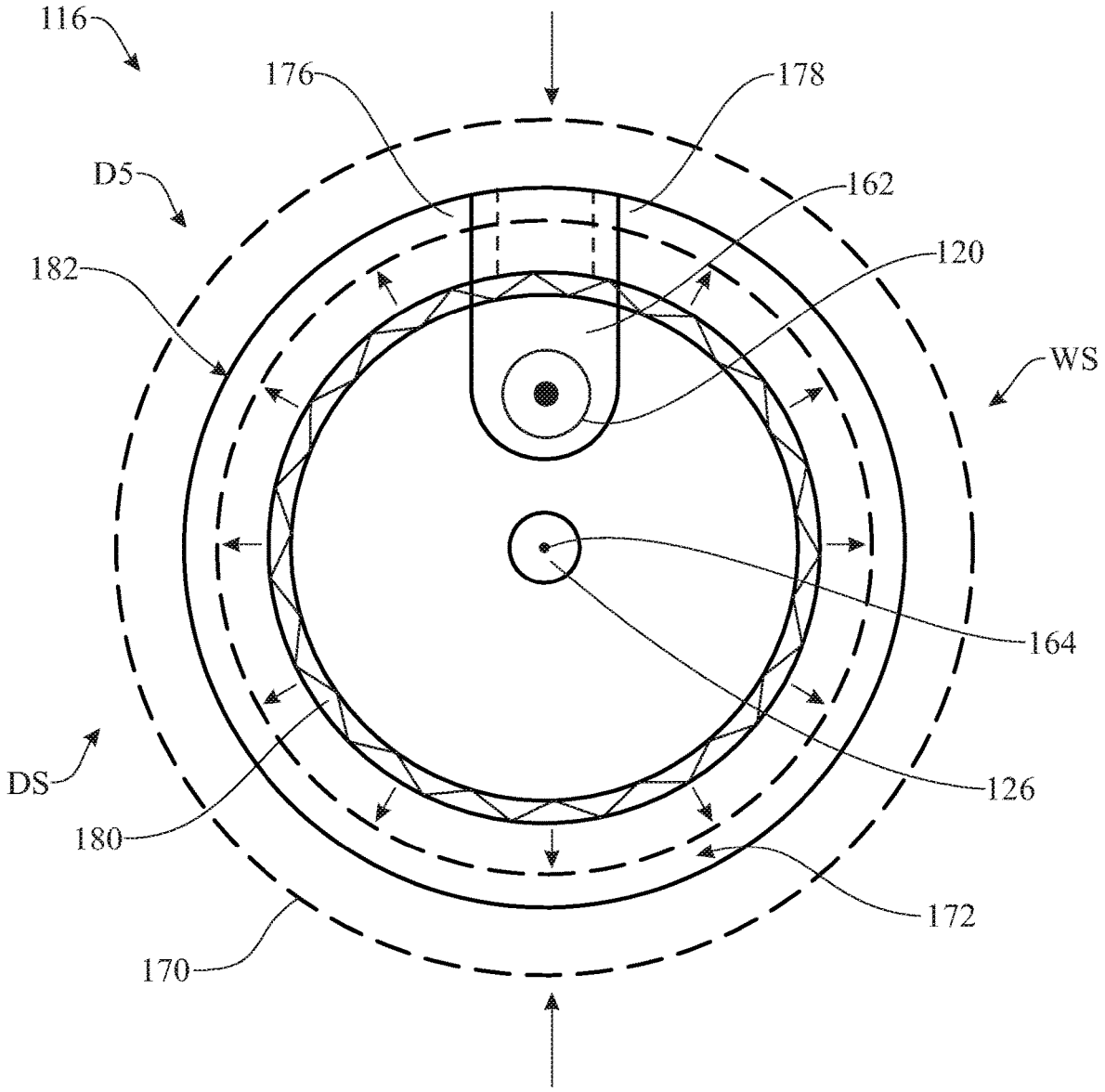
FIG. 3 presents a schematic front elevation view of the bottom wheel of the power-generating wheel system of FIG. 1.
Figure 4:
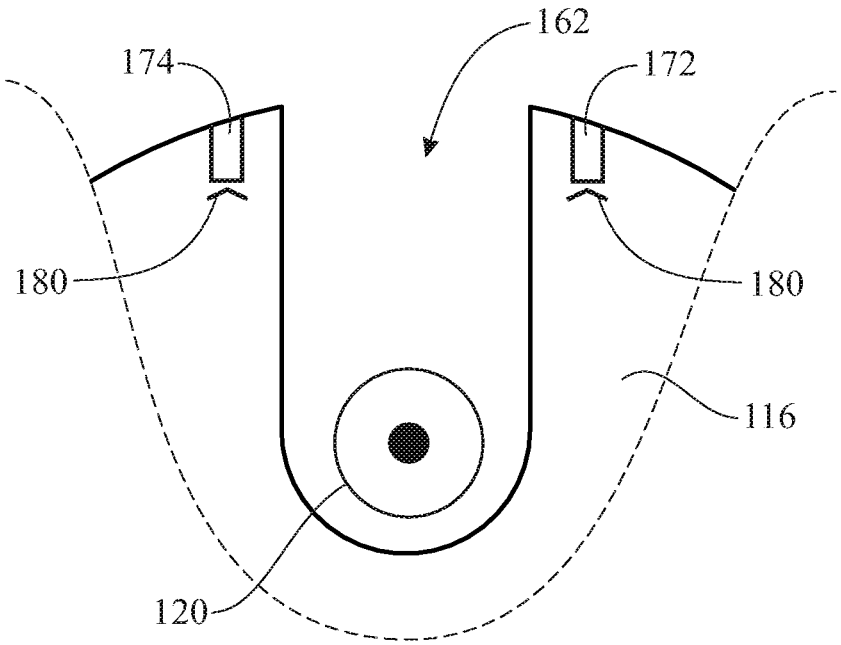
FIG. 4 presents a partial side elevation view of the bottom wheel of FIG. 1, showing a pair of sealing rings and expansion springs.
Figure 5:
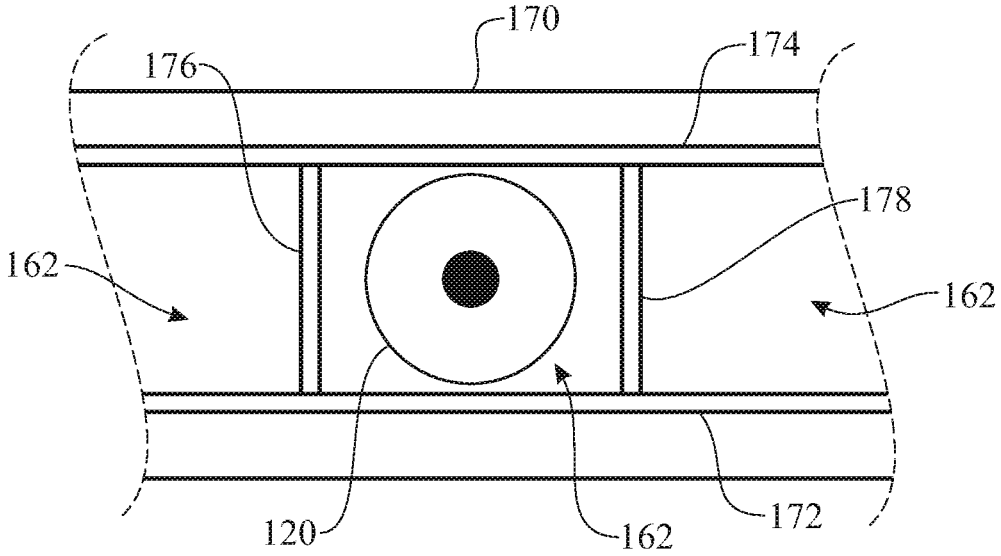
FIG. 5 presents a partial top plan view of the bottom wheel of FIG. 1, illustrating the sealing rings and transverse sealing rails.

Referring to FIGS. 3-5, further details of the bottom wheel 116 will now be described. As described heretofore, the bottom wheel 116 functions as a sealed, rotating liquid valve that transfers return liquid between the riser tube 118 of the drive system 110 and the liquid return system 140 while allowing the air balls 120 to be released up into the liquid column 119 in the riser tube 118 without any back pressure on the air balls 120. The bottom wheel 116 of the present embodiment generally includes a sealed outer casing or housing 170 containing a pair of large side sealing plates or rings 172 and 174 which are free to rotate within the housing 170. While not specifically shown, outer edges of the side sealing rings 172 and 174 ride within complimentary grooves cut in an inner surface of the outer housing 170. The side sealing rings 172 and 174 are flexible so that they may be urged outwardly and provide a sealing effect. The buckets 162 of the bottom wheel 116 are defined by the side sealing rings 172 and 174 as well as a series of transverse or cross sealing rails 176 and 178 (FIG. 5). As best shown in FIGS. 3 and 4, a single or series of expansion springs 180 are provided to urge the side sealing rings 172 and 174, as well as the cross sealing rails 176 and 178, radially outward into sealing engagement within the grooves in the outer housing 170. For example, the one or more expansion rings 180 can consist of two slit rings extending along the respective two side sealing rings 172 and 174 and arranged radially inward of the side sealing rings 172 and 174 to deform said rings outward.

As noted hereinabove, the bottom wheel 116 receives liquid from the riser tube 118. Specifically, liquid passing through the riser tube 118 enters the buckets 162 and deposits the liquid back into the liquid return system 140 (FIG. 1). The side sealing rings 172 and 174 along with the cross sealing rails 176 and 178 form a liquid valve 182 within the outer housing 170 of the bottom wheel 116. As the bottom wheel 116 rotates, liquid is contained within the buckets 162 on a "wet side" of rotation of the liquid valve 182 (the wet side being the right-hand side in the position of FIGS. 1-3, and indicated with reference "WS" in FIG. 3) and is absent from the buckets 162 on a "dry side" of rotation of liquid valve 182 of the bottom wheel 116 (the dry side being the left-hand side in the position of FIGS. 1 and 2, and indicated as "DS" in FIG. 3). In order to reduce the friction of rotation of the liquid valve 182 within the outer housing 170, the grooves in the outer housing 170 are cut deeper on the dry side "DS" of the housing 170 and less so on the wet side "WS" of the housing 170 reducing the friction on the side sealing rings 172 and 174 as they rotate through the dry side "DS" of the outer housing 170. This maintains a constant liquid pressure between the liquid in the riser tube 118 and the bucket 162 positioned directly below the riser tube to allow the air balls to be released from the bucket 162 into the riser tube 118 without any liquid back pressure. Additionally, the deeper groove depth on the dry side "DS"

allows any excess air pressure or vacuum to escape as the buckets 162 pass through the dry side "DS".

With reference to FIGS. 1 and 2, as the liquid valve 182 rotates within the outer housing 170 of the bottom wheel 116, the liquid valve 182 rotates the output shaft 126 of the bottom wheel 182 to rotate the drive belt 128. It should be noted that the drive belt 128 may, alternatively, be a chain similar to the drive chain 122 described hereinabove. In some embodiments, the drive belt 128 can be connected to a transfer assembly 184 for increasing the revolutions per minute (rpm) of the system and furnishing a high torque output to an external device. For example, in the present embodiment, the transfer assembly 184 includes a cogged or toothed small wheel 186 affixed to a larger diameter fly wheel 188. The drive belt 128 engages the small wheel 186 of the transfer assembly. The transfer assembly 184 additionally includes an elongated transfer element (such as a belt or chain, and hereinafter referred to generally as transfer belt 190) connected to the larger diameter fly wheel 188. In this particular use of the power-generating wheel system 100, the transfer belt 188 is connected to a cogged or toothed drive wheel 192 of an electric generator 194 to operate the electric generator 194.

As noted hereinabove, the liquid return system 140 includes a dump sluice 142 and a liquid wheel 144. The dump sluice 142 can include a raised upstream end 196 and a downwardly-directed downstream end 198. The raised upstream end 196 prevents liquid from exiting that end of the dump sluice 142 as liquid is dumped from the buckets 162 of the bottom wheel 116 into the dump sluice 142, while the downwardly-directed downstream end 198 directs the liquid into catchment buckets 200 provided on the liquid wheel 144. The liquid wheel 144 rotates about a central axis 202 to deposit the liquid into the bottom tank 138 of the liquid supply system 112. As shown, the liquid tank 138 is formed within a base 204 of the power-generating wheel system 100 while the dump sluice 128 is positioned on a raised portion 206 of the base 204 directly beneath the bottom wheel 116.

Referring now to FIGS. 1 and 2, the operation of the power-generating wheel system will now be described. Initially, a liquid, such as, but not limited to water, is provided within the liquid supply system 112. The riser tube 118 is filled with liquid and a supply of liquid is located within the liquid pressure tank 130 to a level W1. Liquid also fills the liquid supply tube 132 to prevent any air pockets or leaks in the liquid supply system 112. The liquid pressure tank 130 may additionally include a liquid pressure cover or cap 208 affixed to the liquid pressure tank 130 which can contribute to maintain liquid pressure within the liquid supply system 112. The output shaft 126 of the bottom wheel 116 is locked and the ball return chute 124 is at least half full of air balls 120. In turn, the riser tube 118 is filled with air balls 120. Additionally, the bottom tank 138 is filled with liquid to a level W2 sufficient to submerse a pickup end 210 of the liquid line 136 below the liquid level W2 in order to allow the liquid pump 134 to maintain a constant source and pressure of liquid within the liquid pressure tank 130. A pressure gauge (not shown) may be provided on the liquid pump 134 to monitor the liquid pressure within the system. This sets the power-generating wheel system to an initial or start position.

The power-generating wheel system 100 is powered by two sources of energy, the first being the rising force of the air balls 120 passing through the liquid column 119 in the riser tube 118 acting on the top wheel 114 and the second source of energy being the weight of the liquid column 119 due to gravity acting on the bottom wheel 116. In the present embodiment, the drive system 110 moves generally in the counter direction as viewed in FIGS. 1 and 2, while the liquid supply system 112 and the liquid return system 140 flow generally in the counter-clockwise direction in the power-generating wheel system 100.

Once the power-generating wheel system 100 has been set or "loaded" to the initial start condition, the output shaft 126 can be released to start the system. The first source of driving energy (i.e. an upward force exerted by the rising air balls 120) operates on the power-generating wheel system 100 by pushing the top wheel 114 into rotation by the rising air balls 120. Specifically, the centerline 220 of the riser tube 118 is offset (in these figures, to the left) from the central pivot point 152 of the top wheel 114 to create a first moment arm M1, as best seen in FIG. 2.

With specific reference to FIG. 1, as the air balls 120 rise through the liquid column 119 in the riser tube 118 they accelerate upwardly in the direction of arrow A due to buoyancy. Once the air balls 120 reach the top opening 146 of the riser tube 118, they "pop" up and out of the liquid column 119 and into a receiver cavity 150 in top wheel 114. Since the centerline 119 of the riser tube 118 is offset by the first moment arm M1 (FIG. 2) from the central pivot point 152 of the top wheel 114, the force of the rising air ball 120 into the receiver cavity 150 forces the top wheel 114 to rotate clockwise in the direction of arrow B. This in turn causes the drive chain 122 to move or rotate in the clockwise direction of arrow C.

As the drive chain 122 is rotated in the clockwise direction of arrow C, it rotates the bottom wheel 116 in the clockwise direction of arrow D, which in turn rotates the drive belt 128 in the clockwise direction of arrow E to power an external device. In this embodiment, the transfer assembly 184 can be provided to increase the revolutions per minute (rpm) of the system. Thus, the rotation of the drive belt 128 rotates the fly wheel 188 in the clockwise direction of arrow F thereby rotating the transfer belt 190 in the clockwise direction of arrow G. The rotating transfer belt 190 thus rotates the drive wheel 192 of the electric generator 194 in the clockwise direction of arrow H to provide rotary driving power to the electric generator 194 which produces electricity for other uses.

As shown, once the air balls 120 have released their energy into the top wheel 114, they are dumped into the return chute 124 through the top opening 158 of the return chute. The air balls 120 fall down through the return chute 124 until they exit the bottom opening 160 of the return chute 124 where they enter the buckets 162 of the bottom wheel 116. It should be noted that the air balls 120 enter the bottom buckets 162 on the dry side DS (FIG. 3) of the bottom wheel 116. As the bottom wheel 116 rotates in the direction of arrow D, the buckets 162 containing the air balls 120 are positioned beneath the bottom opening 148 of the riser tube 118 to reposition the air balls 120 for release into the liquid column 119 in the riser tube 118 to complete the cycle.

Turning now specifically to FIG. 2, the flow of the second source of energy for powering the power-generating wheel system 100 will now be described. As noted hereinabove, the liquid pressure tank 130 serves as a source of pressurized liquid. The pressurized liquid is forced through the liquid supply tube 132 towards the top wheel 114 as indicated by arrow J and into the riser tube 118 where it flows downward in the direction of arrow K. A pressure sensor or gauge 212 may be provided in the liquid supply tube 132 to monitor the system and maintain a constant flow of liquid through the system. It should be noted that, since the diameter of the riser tube 118 is substantially larger than the diameter of the liquid supply tube 132, the velocity of the liquid flowing downward through the riser tube 118 slows dramatically.

As the liquid exits the bottom opening 148 of the riser tube 118, it fills the bucket 162 of the bottom wheel 116 positioned directly below the bottom opening 148. At this position, the bucket 162 contains an air ball 120. As the bucket 162 fills with liquid, the air ball 120 is allowed to rise toward the liquid column 119 in the riser tube 118. Once the bucket 162 is completely filled with liquid, and forms a solid column of liquid with the liquid column 119 in the riser tube 118, the air ball 120 begins to rise through the liquid column 119 due to the buoyant effect of the liquid on the much less dense air ball 120.

Similar to the rise of the air balls 120 into the top wheel 114, described hereinabove, the center line 220 of the riser tube 118 is offset to the right of the pivot point 164 of the bottom wheel 116 to create a second moment arm M2 in the power-generating wheel system 100. Thus, the liquid flowing out of the bottom opening 148 of the riser tube 118 and exiting into the underlying bucket 162 contributes to rotate the bottom wheel 116 in the clockwise direction due to the force being applied to the bottom wheel 116 by the downward falling water with the second moment arm M2. The clockwise rotation of the bottom wheel 116 drives the electric generator 194 to produce local power.

As noted hereinabove, and in order to maintain the system, the waste liquid released from the buckets 162 as the buckets 162 pass over the dump sluice 142 is recycled back into the system of the power-generating wheel system 100. Specifically, the waste liquid flows as indicated by arrow L along the dump sluice 142, and exits the downwardly-directed end 198 and is projected in the direction of arrow M into catchment buckets 200 on the liquid wheel 144. This rotates the liquid wheel 144 clockwise in the direction of arrow N, about the central axis 202, until the catchment buckets 200 are presented to the bottom tank 138 which receives the liquid falling out of the catchment buckets 200. This reserve liquid in the bottom tank 138 is then available to replenish the liquid the pressure tank 130 to complete the second energy system.

Specifically, the reserve liquid in the bottom tank 138 is picked up by the pickup end 210 of the liquid line 136 and drawn up through the liquid line 136 as indicated by arrow O until it is forced back into the liquid pressure tank 130. The liquid pump 134 provides the force to both draw liquid up out of the bottom tank 138 and force it into the liquid pressure tank 130.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A power-generating wheel system comprising:

a drive system including an ascending, hollow riser tube having a top opening and a bottom opening, wherein said riser tube is configured to contain a liquid forming a liquid column within said riser tube;

a rotatable, first wheel positioned adjacent said top opening of said riser tube and having a plurality of receiver cavities configured to sequentially align with the top opening of the riser tube, a pivot point of said first wheel being horizontally offset from a centerline of said riser tube to a first side;

a rotatable, second wheel positioned adjacent said bottom opening of said riser tube and having a plurality of receiver cavities configured to sequentially align with the bottom opening of the riser tube, a pivot point of said second wheel being horizontally offset from said centerline of said riser tube to a second side opposite said first side;

an elongated drive element connecting said first wheel to said second wheel such that a rotation of the first wheel causes a rotation of the second wheel via the elongated drive element;

a plurality of buoyant balls each charged with a buoyant gas external of said drive system and configured to be buoyant in and to float up through the liquid;

a liquid supply system configured to maintain said riser tube full of the liquid such that each of said plurality of buoyant balls rising through the liquid column of the liquid exits said top opening of said riser tube and enters one of said receiver cavities of said first wheel with a buoyant force causing said first wheel to rotate and consequently transmitting rotation to said second wheel through said elongated drive element, thereby translating said buoyant force of each of said plurality of buoyant balls into a mechanical torque;

said liquid supply system comprises a first liquid tank, a pressurized liquid supply tube providing fluid communication from the first liquid tank to the top opening of the riser tube, a second liquid tank configured to receive liquid from the plurality of receiver cavities of the second wheel, a liquid line providing fluid communication from the second tank to the first tank, and a pump configured to pump liquid through the liquid line from the second tank to the first tank, wherein said pump is powered by an energy source external of said drive system, and wherein the drive system further includes a second elongated drive element connecting the second wheel to an external device to be powered.

2. The power-generating wheel system of claim 1, wherein each receiver cavity of the second wheel is configured to face the bottom opening of the riser tube such that liquid is transferred from the riser tube to the receiver cavity and a buoyant ball housed within the receiver cavity is buoyantly released from the receiver cavity into the riser tube.

3. The power-generating wheel system of claim 2, wherein the second wheel is configured to rotate by a torque applied on the second wheel by said liquid being transferred to said each receiver cavity from the riser tube.

4. The power-generating wheel system of claim 1, wherein the drive system further includes a return chute having a top opening adjacent the top wheel for receiving buoyant balls from the receiver cavities of the top wheel.

5. The power-generating wheel system of claim 4, wherein the return chute comprises a bottom opening adjacent the bottom wheel for depositing the buoyant balls into the receiver cavities of the second wheel.

6. The power-generating wheel system of claim 1, further comprising a transfer assembly connected to the second elongated drive element to transfer a torque received from the second elongated drive element to the external device.

7. The power-generating wheel system of claim 6, wherein the transfer assembly further comprises a flywheel and an elongated transfer element connected to the external device.

8. The power-generating wheel system of claim 1, wherein the second wheel comprises a stationary housing containing a rotatable valve which is rotatable relative to the housing and contains the plurality of receiver cavities of the second wheel, and further wherein the housing includes a dry side through which the rotatable valve rotates devoid of liquid and a wet side through which the rotatable valve rotates when the rotatable valve contains liquid in the receiver cavities.

9. The power-generating wheel system of claim 8, wherein the receiver cavities of the rotatable valve are defined by a first side sealing ring, a second side sealing ring and cross sealing rails which provide a sealed fluid communication between each receiver cavity of the rotatable valve and the bottom opening of the riser tube.

10. The power-generating wheel system of claim 1, wherein the liquid supply system comprises a liquid tank and a pressurized liquid supply tube providing fluid communication from the liquid tank to the top opening of the riser tube.

11. The power-generating wheel system of claim 1, wherein the liquid supply system comprises a liquid tank configured to receive liquid from the plurality of receiver cavities of the second wheel.

12. The power-generating wheel system of claim 11, further comprising a liquid return system including a dump sluice positioned beneath the second wheel and a liquid wheel positioned within the liquid tank, the dump sluice receiving liquid from the receiver cavities of the second wheel and forcing the liquid onto the liquid wheel to return the liquid to the liquid tank.

13. The power-generating wheel system of claim 1, wherein the riser tube is vertical.

14. The power-generating wheel system of claim 1, wherein the liquid comprises water.

15. The power-generating wheel system of claim 1, wherein the liquid is water.

16. A power-generating wheel system comprising:

a drive system including an ascending, hollow riser tube having a top opening and a bottom opening, wherein said riser tube is configured to contain a liquid forming a liquid column within said riser tube;

a rotatable, first wheel positioned adjacent said top opening of said riser tube and having a plurality of receiver cavities configured to sequentially align with the top opening of the riser tube, a pivot point of said first wheel being horizontally offset from a centerline of said riser tube to a first side;

a rotatable, second wheel positioned adjacent said bottom opening of said riser tube and having a plurality of receiver cavities configured to sequentially align with the bottom opening of the riser tube, a pivot point of said second wheel being horizontally offset from said centerline of said riser tube to a second side opposite said first side;

an elongated drive element connecting said first wheel to said second wheel such that a rotation of the first wheel causes a rotation of the second wheel via the elongated drive element;

a plurality of buoyant balls each charged with a buoyant gas external of said drive system and configured to be buoyant in and to float up through the liquid;

a liquid supply system configured to maintain said riser tube full of the liquid such that each of said plurality of buoyant balls housed within a receiver cavity of the second wheel facing the bottom opening of the riser is buoyantly released from the receiver cavity into the riser tube and the receiver cavity of the second wheel receives liquid from the riser tube causing said second wheel to rotate, and further such that each of said plurality of buoyant balls rising through the liquid column in the riser tube exits said top opening of said riser tube and enters one of said receiver cavities of said first wheel with a buoyant force causing said first wheel to rotate and consequently transmitting rotation to said second wheel through said elongated drive element, thereby translating said buoyant force of each of said plurality of buoyant balls into a mechanical torque;

said liquid supply system comprises a first liquid tank, a pressurized liquid supply tube providing fluid communication from the first liquid tank to the top opening of the riser tube, a second liquid tank configured to receive liquid from the plurality of receiver cavities of the second wheel, a liquid line providing fluid communication from the second tank to the first tank, and a pump configured to pump liquid through the liquid line from the second tank to the first tank, wherein said pump is powered by an energy source external of said drive system, and wherein the drive system further includes a second elongated drive element connecting the second wheel to an external device to be powered.

17. A power-generating wheel system comprising:

a drive system including an ascending, hollow riser tube having a top opening and a bottom opening, wherein said riser tube is configured to contain a liquid forming a liquid column within said riser tube;

a rotatable, first wheel positioned adjacent said top opening of said riser tube and having a plurality of receiver cavities configured to sequentially align with the top opening of the riser tube, a pivot point of said first wheel being horizontally offset from a centerline of said riser tube to a first side;

a rotatable, second wheel positioned adjacent said bottom opening of said riser tube and having a plurality of receiver cavities configured to sequentially align with the bottom opening of the riser tube, a pivot point of said second wheel being horizontally offset from said centerline of said riser tube to a second side opposite said first side;

an elongated drive element connecting said first wheel to said second wheel such that a rotation of the first wheel causes a rotation of the second wheel via the elongated drive element;

a plurality of buoyant balls each charged with a buoyant gas external of said drive system and configured to be buoyant in and to float up through the liquid;

a return chute having a top opening adjacent the top wheel for receiving each of said plurality of buoyant balls from the receiver cavities of the top wheel and a bottom opening adjacent the bottom wheel for depositing each of said plurality of buoyant balls into the receiver cavities of the second wheel;

a liquid supply system configured to maintain said riser tube full of the liquid such that each of said plurality of buoyant balls housed within a receiver cavity of the second wheel facing the bottom opening of the riser is buoyantly released from the receiver cavity into the riser tube and the receiver cavity of the second wheel receives liquid from the riser tube causing said second wheel to rotate, and further such that each of said plurality of buoyant balls rising through the liquid column in the riser tube exits said top opening of said riser tube and enters one of said receiver cavities of said first wheel with a buoyant force causing said first wheel to rotate and consequently transmitting rotation to said second wheel through said elongated drive element, thereby translating said buoyant force of each of said plurality of buoyant balls into a mechanical torque;

said liquid supply system comprises a first liquid tank, a pressurized liquid supply tube providing fluid communication from the first liquid tank to the top opening of the riser tube, a second liquid tank configured to receive liquid from the plurality of receiver cavities of the second wheel, a liquid line providing fluid communication from the second tank to the first tank, and a pump configured to pump liquid through the liquid line from the second tank to the first tank, wherein said pump is powered by an energy source external of said drive system, and wherein the drive system further includes a second elongated drive element connecting the second wheel to an external device to be powered.

* * * * *